US007973785B2

(12) United States Patent
Lee et al.

(10) Patent No.: US 7,973,785 B2
(45) Date of Patent: Jul. 5, 2011

(54) CONTROL BOARD AND DISPLAY APPARATUS HAVING THE SAME

(75) Inventors: Jun-Pyo Lee, Cheonan-si (KR); Bong-Hyun You, Yongin-si (KR); Jae-Hyeung Park, Yongin-si (KR); Jae-Sung Bae, Cheonan-si (KR); Woo-Chul Kim, Euijeongbu-si (KR)

(73) Assignee: Samsung Electronics Co., Ltd. (KR)

( * ) Notice: Subject to any disclaimer, the term of this patent is extended or adjusted under 35 U.S.C. 154(b) by 840 days.

(21) Appl. No.: 11/974,411

(22) Filed: Oct. 12, 2007

(65) Prior Publication Data

US 2008/0143698 A1 Jun. 19, 2008

(30) Foreign Application Priority Data

Dec. 13, 2006 (KR) ..... 10-2006-0126857

(51) Int. Cl.
*G09G 5/00* (2006.01)

(52) U.S. Cl. ..... 345/213

(58) Field of Classification Search ..... 345/204, 345/211, 213, 96–100, 698–699, 3.3–3.4; 348/513, 516, 536
See application file for complete search history.

(56) References Cited

U.S. PATENT DOCUMENTS

| | | | | |
|---|---|---|---|---|
| 6,867,759 | B1 * | 3/2005 | Baek et al. | 345/99 |
| 7,038,673 | B2 * | 5/2006 | Lee et al. | 345/211 |
| 2002/0097236 | A1 * | 7/2002 | Aoki et al. | 345/204 |

* cited by examiner

*Primary Examiner* — Alexander Eisen
*Assistant Examiner* — Robin Mishler
(74) *Attorney, Agent, or Firm* — Innovation Counsel LLP

(57) ABSTRACT

In a control board and a display apparatus, the control board includes a timing controller, and first and second connectors. The timing controller receives a first external image control signal having one of a first and a second frequency, and selectively receives a second external image control signal having the first frequency when the first external image control signal has the first frequency. The timing controller selects one of the first and second frequencies based on the first and second external image control signals to output an image driving signal. The first connector connects the timing controller to an external video system to transfer the first external image control signal to the timing controller. The second connector connects the timing controller to the external video system to transfer the second external image control signal to the timing controller. Thus, the control board is commonly used in the first and second frequencies.

15 Claims, 7 Drawing Sheets

CONTROL BOARD AND DISPLAY APPARATUS HAVING THE SAME

CROSS-REFERENCE TO RELATED APPLICATIONS

This application claims priority under 35 U.S.C. §119 to Korean Patent Application No. 10-2006-126857, filed on Dec. 13, 2006 in the Korean Intellectual Property Office (KIPO), the contents of which are herein incorporated by reference in their entirety.

BACKGROUND OF THE INVENTION

1. Field of the Invention

The present invention relates to a display apparatus. More particularly, the present invention relates to a control board and a display apparatus having the control board.

2. Description of the Related Art

Generally, a liquid crystal display (LCD) apparatus provides desirable characteristics, such as thin thickness, light weight, and low power consumption, so that the LCD apparatus is used for monitors, laptop computers, mobile phones, large televisions. Typically, an LCD apparatus includes an LCD panel for displaying an image using light transitivity of liquid crystal, a driving unit electrically connected to the LCD panel to drive the LCD panel, and a control board electrically connected to the driving unit to control the driving unit.

The control board includes a connector electrically connected to an external video system and a signal processing part processing a signal received from the video system.

The LCD apparatus is generally driven with a frequency of 60 Hz, but presently may be driven with a frequency of 120 Hz to enhance the display quality of the image. However, the signal processing part preset to correspond to 60 Hz is only used to drive the LCD apparatus with the frequency of 60 Hz, and the signal processing part preset to correspond to 120 Hz is only used to drive the LCD apparatus with the frequency of about 120 Hz.

Thus, the control board is required to be substituted, for the LCD apparatus to be driven with both frequencies of 60 Hz and 120 Hz.

SUMMARY OF THE INVENTION

The present invention provides a control board automatically converting frequencies without having to substitute the control board.

The present invention also provides a display apparatus having the control board.

In an example control board receiving video information from a video system, the video information including image control signals, the control board according to the present invention, the control board includes a timing controller, a first connector and a second connector. The timing controller is adapted to receive a first external image control signal having one of a first frequency and a second frequency and to selectively receive a second external image control signal having the first frequency when the first external image control signal has the first frequency, and the timing controller is operative to select one of the first and second frequencies based on the first and second external image control signals and to provide at an output an image driving signal. The first connector connects the timing controller to the video system and transfers the first external image control signal to the timing controller. The second connector connects the timing controller to the video system and transfers the second external image control signal to the timing controller. For example, the timing controller may include a signal processing part outputting the image driving signal in response to the first and second external image control signals, and a frequency selection part automatically selecting one of the first and second frequencies based on the first external image control signal, to control the signal processing part. The timing controller may include a first signal receiving part electrically connected to the first connector, to receive the first external image control signal, and a second signal receiving part electrically connected to the second connector, to selectively receive the second external image control signal.

The timing controller may further include a signal counter disposed between the first signal receiving part and the frequency selection part and electrically connected to the first signal receiving part and the frequency selection part. Also, the signal counter may receive a data enable signal of the first external image control signal from the first signal receiving part, the counter be operative to count the data enable signal, and generate an internal frequency selection signal.

Alternatively, the control board may further include a logic level shifting circuit electrically coupled to the second connector, and to the frequency selection parts. The logic level shifting circuit is operative to output an external frequency selection signal controlling the frequency selection part to the frequency selection part. The logic level shifting circuit is electrically coupled to a power input pin of the second connector.

For example, the control board may further include a first preset memory electrically coupled to the timing controller, to provide to the timing controller preset data applicable for operation at the first frequency, and a second preset memory electrically coupled to the timing controller, to provide the timing controller preset data applicable for operation at the second frequency.

In an example display apparatus according to the present invention, the display apparatus includes a control board, a driving unit controlled by the control board, and a display panel driven by the driving unit to display an image.

The control board includes a timing controller, a first connector and a second connector. The timing controller is adapted to receive a first external image control signal having one of a first frequency and a second frequency to selectively receive a second external image control signal having the first frequency when the first external image control signal has the first frequency. The timing controller is operative to select one of the first and second frequencies based on the first and second external image control signals and to provide at an output an image driving signal. The first connector connects the timing controller to the video system and transfers the first external image control signal to the timing controller. The second connector connects the timing controller to the video system and transfers the second external image control signal to the timing controller. For example, the first frequency is about 120 Hz, and the second frequency is about 60 Hz.

The display apparatus may further include a logic level shifting circuit electrically coupled to the second connector and to the frequency selection parts. The logic level shifting circuit may be operative to output an external frequency selection signal controlling the frequency selection part to the frequency selection part.

The display apparatus may further include a first preset memory and a second preset memory. The first preset memory may be electrically coupled to the timing controller to provide to the timing controller preset data applicable for operation at the first frequency. The second preset memory may be electrically coupled to the timing controller, to provide the timing controller preset data applicable for operation at the second frequency.

The second external image control signal may include odd-numbered line image data when the first external image control signal of the first frequency includes even-numbered line image data. The second external image control signal may include the even-numbered line image data when the first external image control signal of the first frequency include odd-numbered line image data.

According to the present invention, although an image signal having one of first and second frequencies is inputted to a control board, the control board may automatically select one of the first and second frequencies to drive a display panel.

BRIEF DESCRIPTION OF THE DRAWINGS

The above and other features and advantages of the present invention will become more apparent by describing in detailed example embodiments thereof with reference to the accompanying drawings, in which.

DESCRIPTION OF THE EMBODIMENTS

Figure 1:
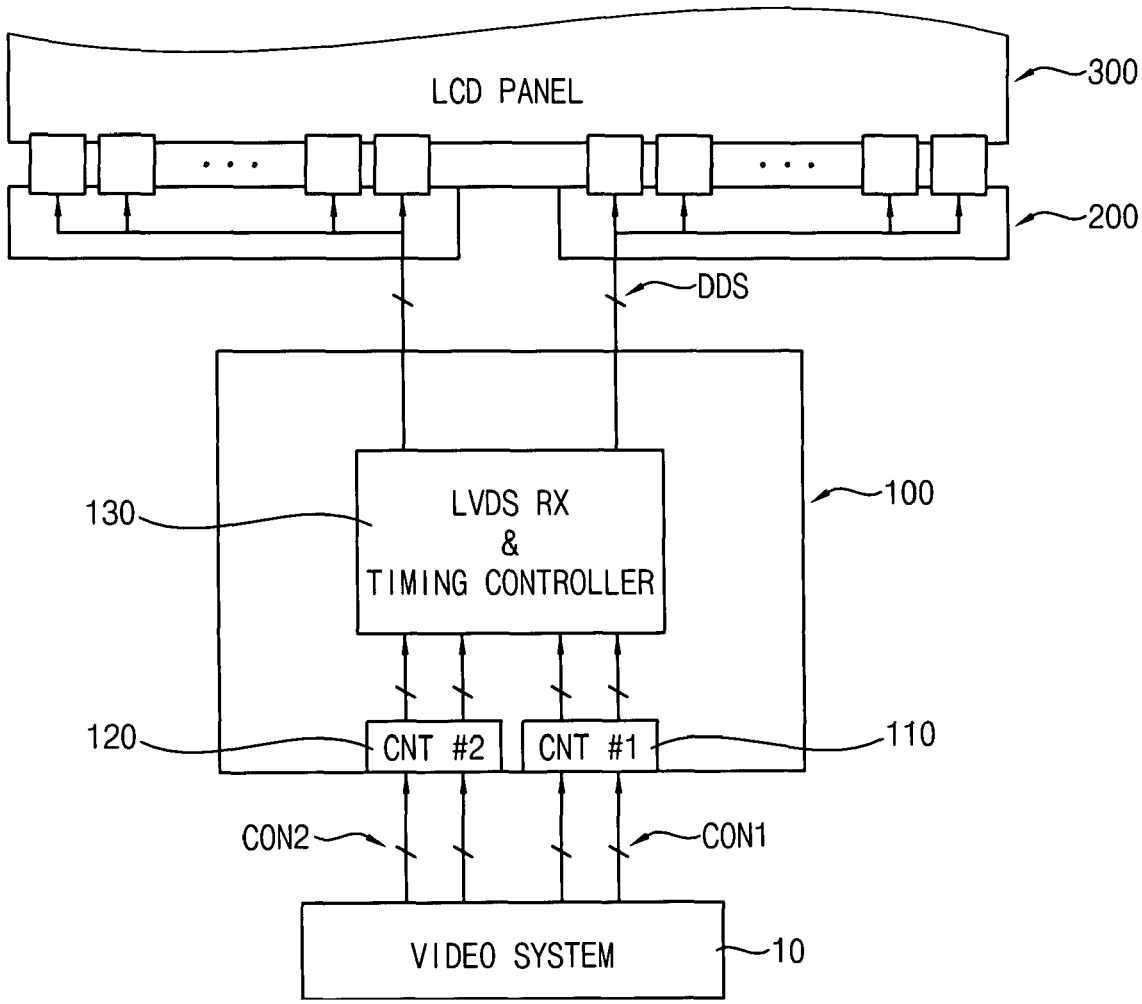
FIG. 1 is a block diagram illustrating a display apparatus according to a first embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
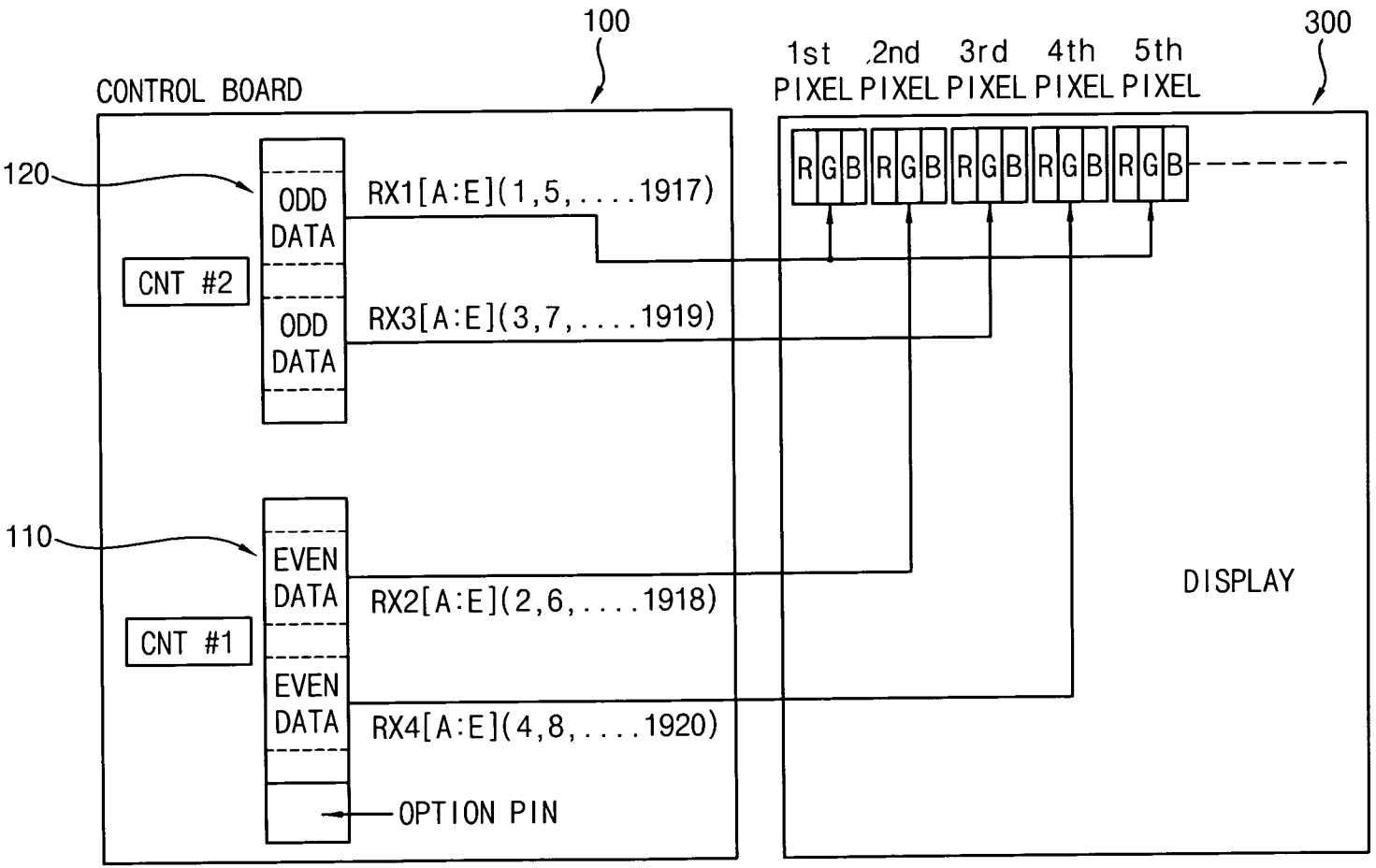
FIG. 2 is a block diagram illustrating the connection relationship between a control board and a display panel in FIG. 1.

FIG. 1 is a block diagram illustrating a display apparatus according to a first embodiment of the present invention. FIG. 2 is a block diagram illustrating the connection relationship between a control board 100 and a display panel 300 in FIG. 1.

Referring to FIGS. 1 and 2, the display apparatus according to the first embodiment includes the control board 100, a driving unit 200 and the display panel 300 for displaying an image.

The control board 100 receives first and second external image control signals CON1 and CON2 from an external video system 10, and outputs an image driving signal DDS to the driving unit 200 in response to the first and second external image control signals CON1 and CON2.

The driving unit 200 receives the image driving signal DDS from the control board 100, and controls the display panel 300 in response to the image driving signal DDS. For example, the image driving signal DDS includes a data driving signal and a gate driving signal, and the driving unit 200 includes a data driving part and a gate driving part.

For example, the data driving part receives the data driving signal from the control board 100, and outputs a data signal to the display panel 300 in response to the data driving signal. The gate driving part receives the gate driving signal from the control board 100, and outputs a gate signal to the display panel 300 in response to the gate driving signal.

The display panel 300 receives the data and gate signals from the driving unit 200, to display an image to the outside. For example, the display panel 300 includes an array substrate, a counter substrate and a liquid crystal layer (all not shown).

The array substrate includes gate lines formed along a first direction, data lines formed along a second direction substantially perpendicular to the first direction, thin-film transistors (TFT) electrically connected to the gate and data lines and pixel electrodes electrically connected to the TFTs. The pixel electrode includes a transparent conductive material. The pixel electrodes are arranged in a matrix shape.

The counter substrate faces the array substrate, and includes a common electrode. The common electrode includes a color filter displaying color and the transparent conductive material. For example, the color filter may include a red color filter, a green color filter and a blue color filter.

The liquid crystal layer is disposed between the array substrate and the counter substrate. An electrical field generated between the pixel electrode and the common electrode changes a longitudinal arrangement direction of liquid crystal molecules in the liquid crystal layer, so that light transitivity is changed.

The control board 100 according to the first embodiment includes a first connector 110, a second connector 120 and an LVDS RX & timing controller 130.

The first connector 110 is electrically connected to the external video system 10, and receives the first external image control signals CON1 having one of the first and second frequencies. In FIGS. 1 and 2, the first frequency is about 120 Hz, and the second frequency is about 60 Hz. For example, the first connector 110 may receive the first external image control signal CON1 having the first frequency of about 120

Hz, or may receive the first external image control signal CON1 having the second frequency of about 60 Hz.

The second connector 120 is electrically connected to the external video system 10 to receive the second external image control signal CON2 having the first frequency of about 120 Hz, when the first external image control signal CON1 having the first frequency of about 120 Hz is applied to the first connector 110. For example, the first connector 110 is electrically connected to the video system 10.

In FIGS. 1 and 2, the first and second external image control signals CON1 and CON2 may be a signal having a low voltage differential signaling (LVDS) mode.

The second connector 120 is electrically connected to the external video system 10 in FIG. 1, so that the video system 10 outputs the second external image control signal CON2 having the first frequency of about 120 Hz to the second connector 120, and the video system 10 outputs the first external image control signal CON1 having the first frequency of about 120 Hz to the first connector 110.

The timing controller 130 is electrically connected to the first connector 110, to receive the first external image control signal CON1 from the first connector 110. The timing controller 130 is electrically connected to the second connector 120, to selectively receive the second external image control signal CON2 from the second connector 120.

The timing controller 130 selects one of the first and second frequencies of about 120 Hz and about 60 Hz based on the first and second external image control signals CON1 and CON2, and outputs the image driving signal DDS to the driving unit 200. For example, the image driving signal DDS may be a signal having a reduced swing differential signaling (RSDS) mode or a mini-LVDS mode, both of which are well known to those skilled in the art.

The first and second external image control signals CON1 and CON2 have the first frequency of about 120 Hz in FIG. 1. Thus, the timing controller 130 determines that the first and second external image control signals CON1 and CON2 have the first frequency of about 120 Hz, so that the timing controller 130 outputs the image driving signal DDS having the first frequency of about 120 Hz.

Referring to FIG. 2, when the first external image control signal CON1 applied to the first connector 110 includes odd-numbered line data, the second external image control signal CON2 applied to the second connector 120 includes even-numbered line data. Alternatively, when the first external image control signal CON1 applied to the first connector 110 includes the even-numbered line data, the second external image control signal CON2 applied to the second connector 120 may include the odd-numbered line data.

The odd-numbered line data drives the pixels of the display panel 300 disposed in odd-numbered lines, and the even-numbered line data drives the pixels disposed in even-numbered lines.

Figure 3:
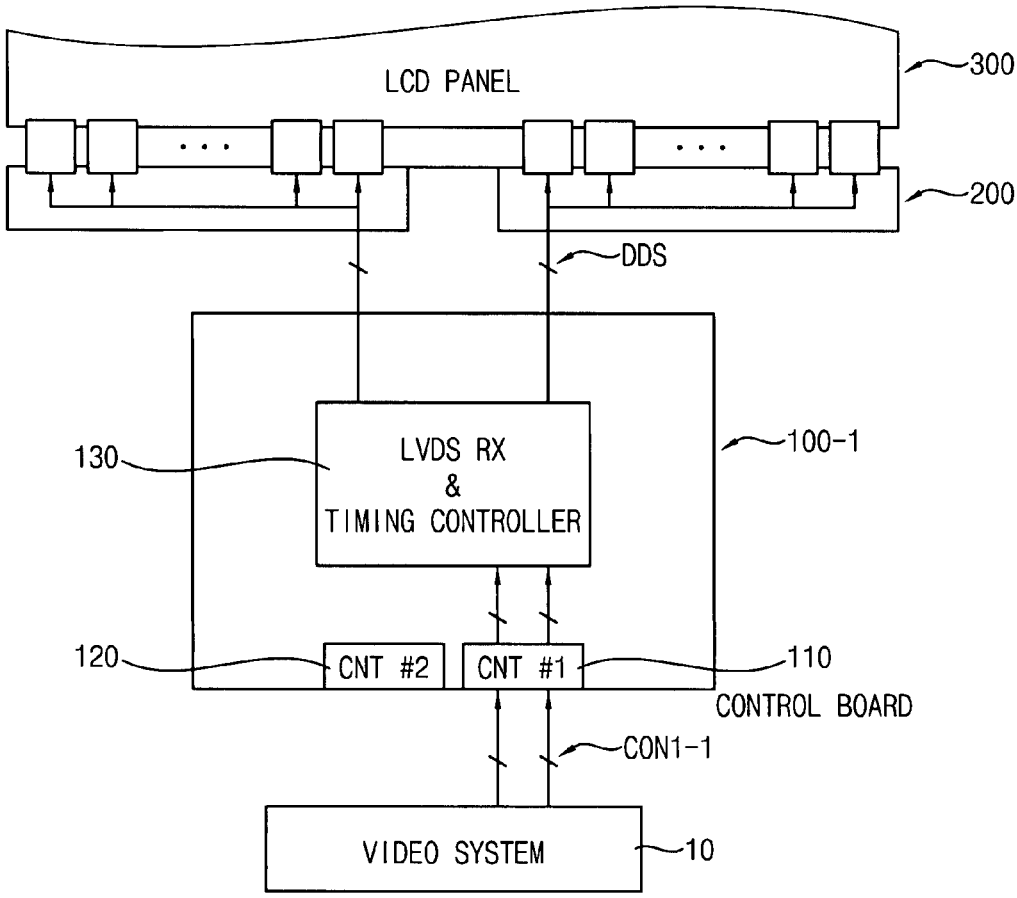
FIG. 3 is a block diagram illustrating a display apparatus according to a second embodiment of the present invention.
Figure 4:
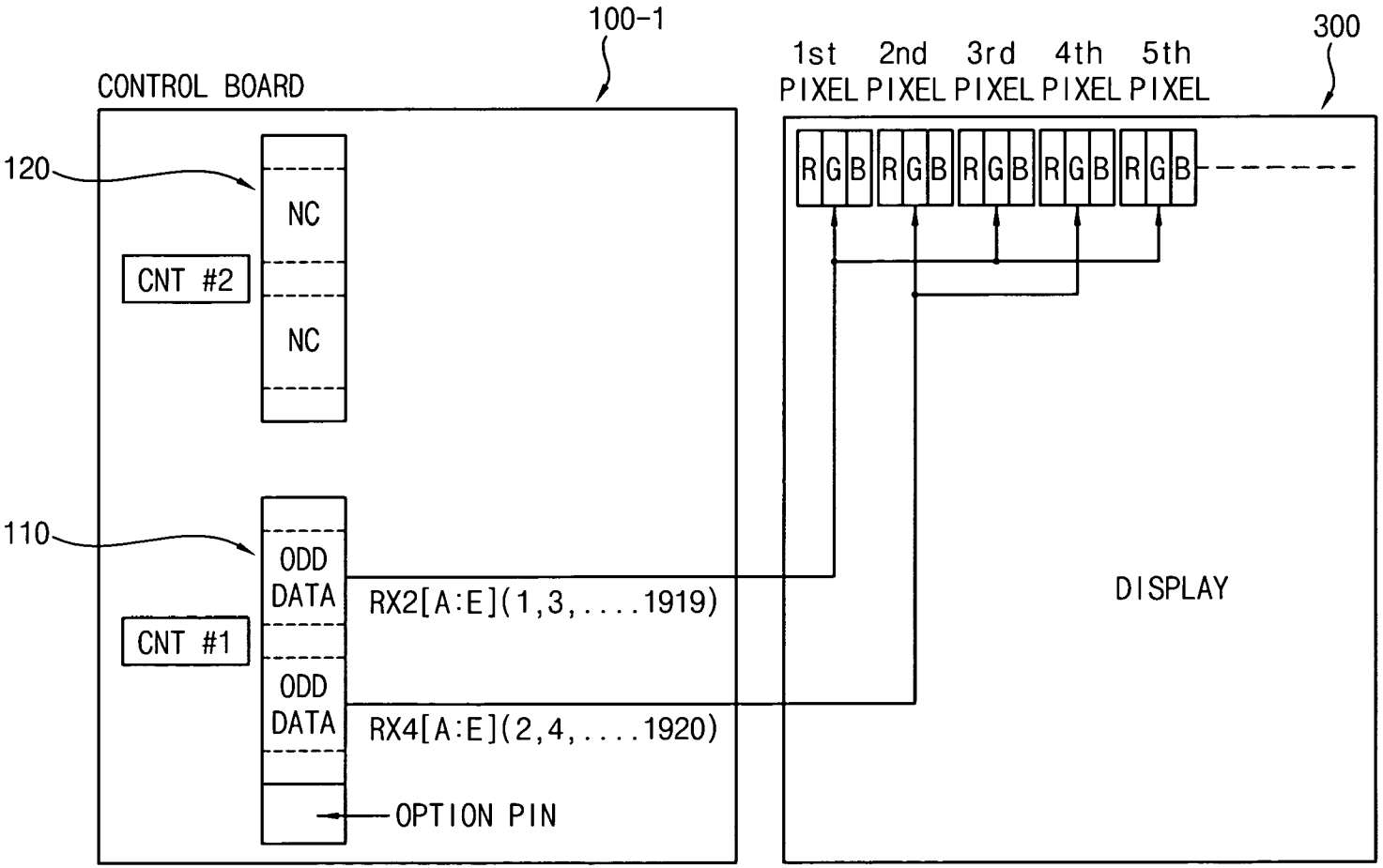
FIG. 4 is a block diagram illustrating the connection relationship between a control board and a display panel in FIG. 3.

FIG. 3 is a block diagram illustrating a display apparatus according a second embodiment of the present invention. FIG. 4 is a block diagram illustrating a connection relationship between a control board and a display panel in FIG. 3.

Referring to FIGS. 3 and 4, the first connector 110 is electrically connected to the external video system 10, but the second connector 120 is not electrically connected to the external video system 10. The first external image control signal CON1 applied to the first connector 110 has the second frequency of about 60 Hz.

For example, the first connector 110 receives the first external image control signal CON1 having the second frequency of about 60 Hz from the external video system 10, to transfer the first external image control signal CON1 to the timing controller 130. The timing controller 130 outputs the image driving signal DDS having the second frequency of about 60 Hz to the driving unit 200 in response to the first external image control signal CON1.

The first external image control signal CON1-1 includes both odd-numbered and even-numbered data, to drive all lines of the pixels of the display panel 300.

Figure 5:
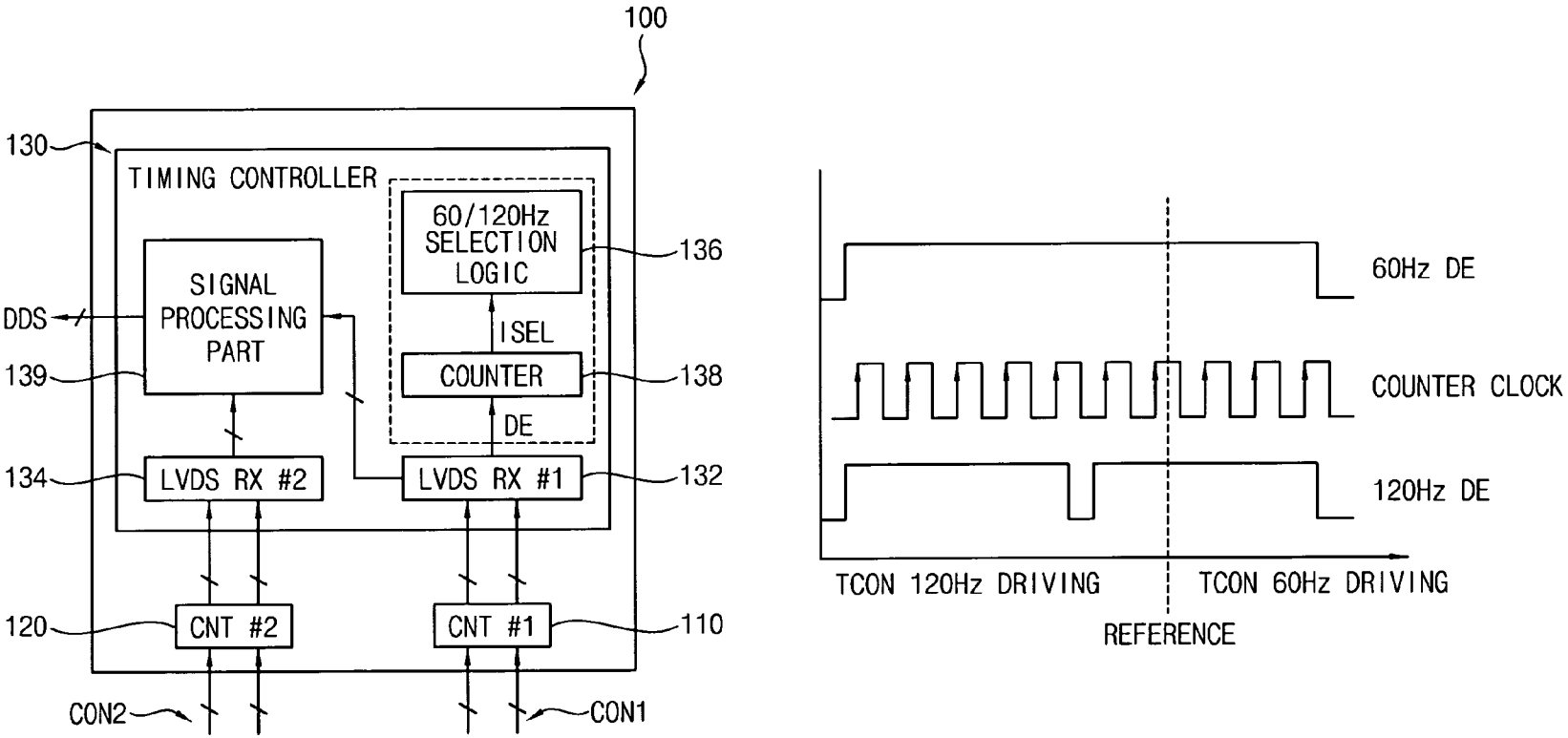
FIG. 5 illustrates a block diagram and a waveform diagram for the control board in FIG. 1.

FIG. 5 is block and waveform diagrams illustrating the control board 100 in FIG. 1 selecting one of first and second frequencies using a data enable signal.

Referring to FIG. 5, the timing controller 130 includes a first signal receiving part 132, a second signal receiving part 134, a signal processing part 139, a frequency selection part 136 and a signal counter 138.

The first signal receiving part 132 is electrically connected to the first connector 110, to receive the first external image control signal CON1. The first signal receiving part 132 changes the first external image control signal CON1 into a voltage having an internal transferring level, to transfer the voltage to the signal processing part 139.

The second signal receiving part 134 is electrically connected to the second connector 120, to selectively receive the second external image control signal CON2. For example, when the second signal receiving part 134 is driven with the frequency of about 120 Hz, the second signal receiving part 134 selectively receives the second external image control signal CON2. The second signal receiving part 134 changes the second external image control signal CON2 into a voltage having the internal transferring level, to transfer the voltage to the signal processing part 139.

The signal processing part 139 processes the first and second external image control signals CON1 and CON2 through various signal processing processes, to output the image driving signal DDS to the driving unit 200.

The frequency selection part 136 automatically selects one of the first and second frequencies of about 120 Hz and about 60 Hz according to the first external image control signal CON1, to control the signal processing part 139. For example, when the first external image control signal CON1 has a first frequency of about 120 Hz, the frequency selection part 136 selects the first frequency of about 120 Hz to control the signal processing part 139. When the first external image control signal CON1 has a second frequency of about 60 Hz, the frequency selection part 136 selects the second frequency of about 60 Hz to control the signal processing part 139.

The signal counter 138 is disposed between the first signal receiving part 132 and the frequency selection part 136, and is electrically connected to the first signal receiving part 132 and the frequency selection part 136. The signal counter 138 receives the data enable signal DE of the first external image control signal CON1 from the first signal receiving part 132, and counts the frequency of the applied data enable signal DE, thereby outputting the internal frequency selection signal ISEL to the frequency selection part 136.

For example, the signal counter 138 counts the data enable signal DE using an internal counter clock. Then, when the counted data enable signal DE is higher than a reference value, the signal counter 138 outputs the internal frequency selection signal ISEL having a low level. However, when the counted data enable signal DE is lower than the reference value, the signal counter 138 outputs the internal frequency selection signal ISEL having a high level.

When the data enable signal DE has the first frequency of about 120 Hz, the counted data enable signal DE is lower than the reference value, so that the signal counter 138 outputs the internal frequency selection signal ISEL having the high level. However, when the data enable signal DE has the second frequency of about 60 Hz, the counted data enable signal DE is higher than the reference value, so that the signal counter 138 outputs the internal frequency selection signal ISEL having the low level.

Accordingly, the signal counter 138 applies the internal frequency selection signal ISEL that is selected by the frequency of the data enable signal DE to the frequency selection part 136, so that the signal counter 138 is controlled to automatically select one of the first and second frequencies of about 120 Hz and about 60 Hz.

Figure 6:
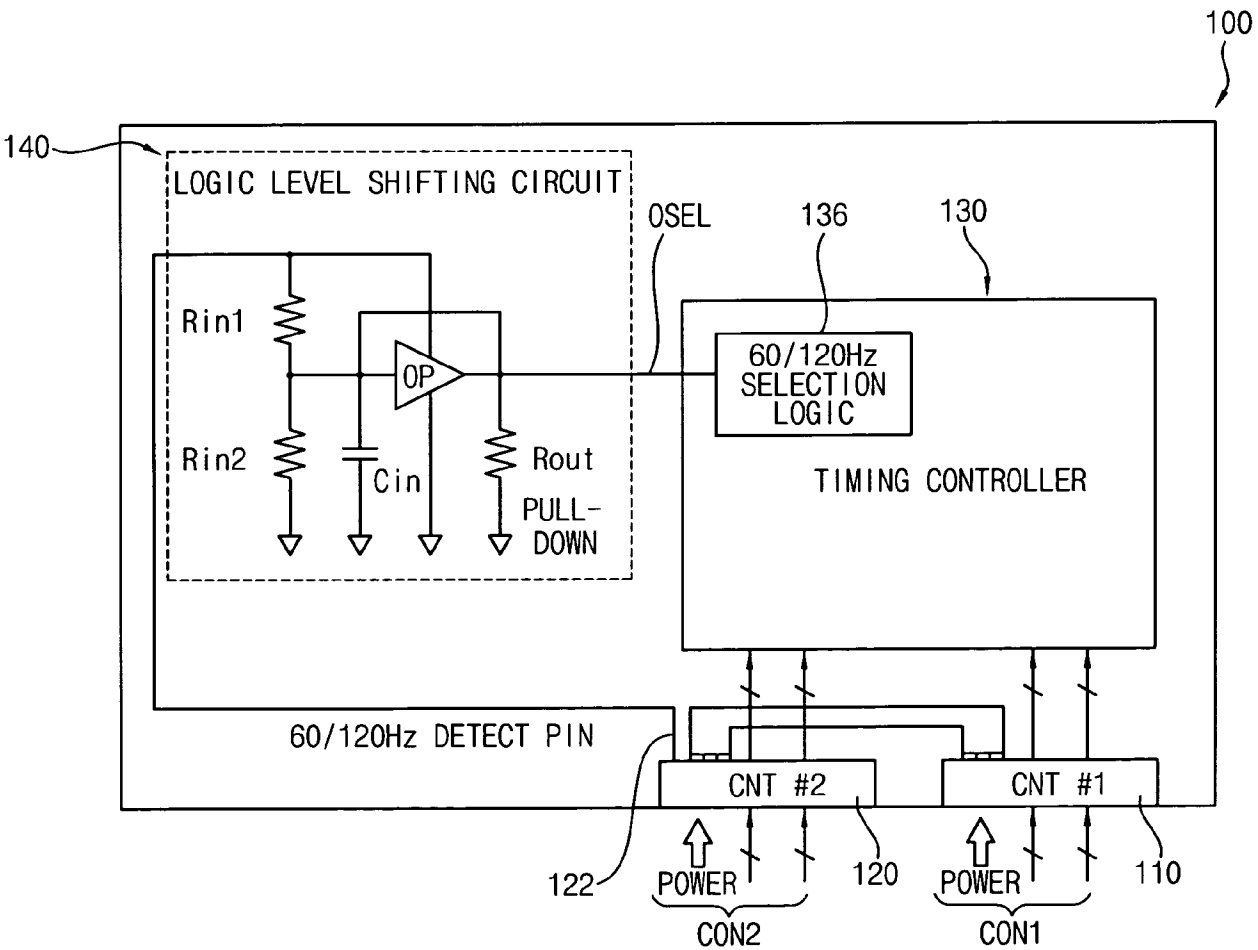
FIG. 6 is a block diagram illustrating in more detail the control board in FIG. 1.

FIG. 6 is a block diagram illustrating the control board in FIG. 1 selecting one of the first and second frequencies using a second connector.

Referring to FIG. 6, the control board 100 may further include a logic level shifting circuit 140, in addition to the first connector 110, the second connector 120 and the timing controller 130.

The logic level shifting circuit 140 is electrically connected to the second connector 120, to output the external frequency selection signal OSEL that controls the frequency selection part 136 to the frequency selection part 136.

For example, an input terminal of the logic level shifting circuit 140 is electrically connected to at least one power input pin 122 of various power input pins, and an output terminal of the logic level shifting circuit 140 is electrically connected to the frequency selection part 136.

For example, the logic level shifting circuit 140 may include a first input resistor Rin1, a second input resistor Rin2, an input capacitor Cin, a signal amplifier OP and a pull-down resistor Rout. FIG. 6 illustrates electrical connections between above-mentioned elements.

When the second external image control signal CON2 is applied to the second connector 120, a power signal of the second external image control signal CON2 is applied to the input terminal of the logic level shifting circuit 140 through the power input pin 122 of the second connector 120. Accordingly, when the power signal is applied to the logic level shifting circuit 140, the logic level shifting circuit 140 outputs the external frequency selection signal OSEL having the high level to the frequency selection part 136.

However, when the second external image control signal CON2 is not applied to the second connector 120, the logic level shifting circuit 140 outputs the external frequency selection signal OSEL having the low level to the frequency selection part 136 through the pull-down resistor Rout.

When the second external image control signal CON2 is applied to the second connector 120, the logic level shifting circuit 140 controls the frequency selection part 136 to select the first frequency of about 120 Hz using the external frequency selection signal OSEL having the high level. When the second external image control signal CON2 is not applied to the second connector 120, the logic level shifting circuit 140 controls the frequency selection part 136 to select the second frequency of about 60 Hz using the external frequency selection signal OSEL having the low level.

For example, power connection pins of the first and second connectors 110 and 120 are electrically connected with each other, to apply electric power to the control board 100.

Figure 7:
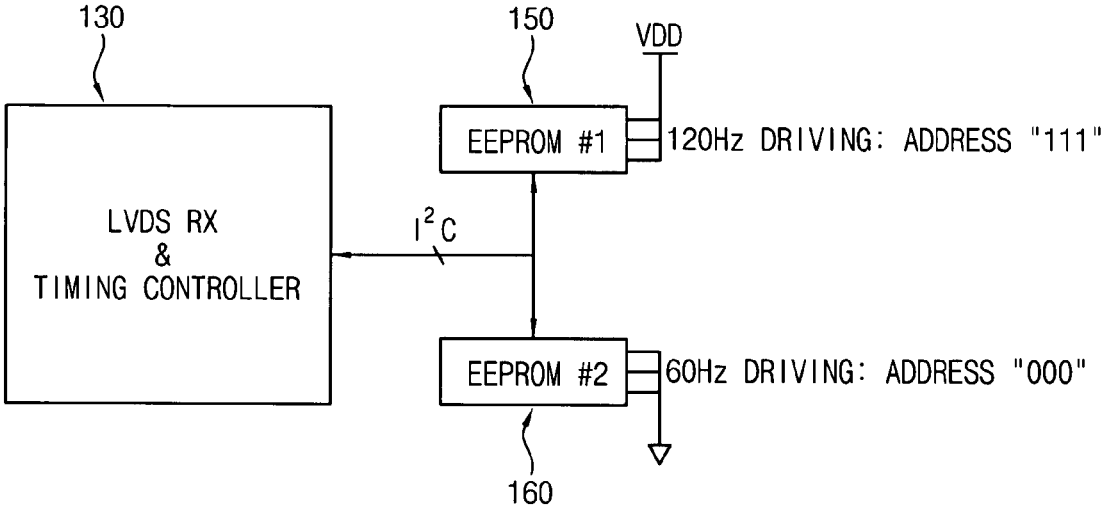
FIG. 7 is a block diagram illustrating the connections between the timing controller in FIG. 1 and first and second preset memories.

FIG. 7 is a block diagram illustrating the LVDS RX and timing controller 130 in FIG. 1 coupled to first and second preset memories 150 and 160, respectively.

Referring to FIGS. 1 and 7, the control board 100 may further include a first preset memory 150 and a second preset memory 160, in addition to the first connector 110, the second connector 120 and the timing controller 130.

The first preset memory 150 stores preset data associated with the system when driven by the frequency of about 120 Hz. The first preset memory 150 is electrically connected to the timing controller 130, to apply the preset data driven by the first frequency of about 120 Hz to the timing controller 130. Thus, the timing controller 130 may output the image driving signal DDS that is processed according to the preset data driven by the first frequency of about 120 Hz.

The second preset memory 160 stores preset data associated with the system when driven by the second frequency of about 60 Hz. The second preset memory 160 is electrically connected to the timing controller 130, to apply the preset data driven by the second frequency of about 60 Hz to the timing controller 130. Thus, the timing controller 130 may output the image driving signal DDS that is processed according to the preset data driven by the second frequency of about 60 Hz.

For example, the timing controller 130 transfers the signal via the first and second preset memories 150 and 160 and an inter-integrated circuit ($I^2C$) bus mode. For example, when the first preset memory 150 has an address of 111 and the second preset memory 160 has an address of 000, the timing controller 130 may search for the address of 111 to read the preset data driven by the first frequency of about 120 Hz, and may search for the address of 000 to read the preset data driven to the second frequency of about 60 Hz.

For example, the preset data stored in the first and second preset memories may include information on timing of the gate and date control signals, a gamma curvature, an overdriving to increase response speed, and so on.

According to the present invention, a control board automatically recognizes an input frame frequency and is automatically driven with a frequency of about 60 Hz or about 120 Hz according to the input frequency, so that a display apparatus may be driven regardless of the driving frequencies. In addition, one control board, rather than two, may be used to accommodate systems where the frequencies are either about 60 Hz or about 120 Hz, thereby decreasing manufacturing costs.

Having described the example embodiments of the present invention and its advantage, it is noted that various changes, substitutions and alterations can be made herein without departing from the spirit and scope of the invention as defined by appended claims.

What is claimed is:

1. A control board receiving video information from a video system, the video information including image control signals, the control board comprising:

a timing controller adapted to receive a first external image control signal having one of a first frequency and a second frequency and to selectively receive a second external image control signal having the first frequency when the first external image control signal has the first frequency, the timing controller being operative to select one of the first and second frequencies based on the first and second external image control signals and to output an image driving signal;

a first connector connecting the timing controller to the video system and transferring the first external image control signal to the timing controller; and a second connector connecting the timing controller to the video system and transferring the second external image control signal to the timing controller.

2. The control board of claim 1, wherein the timing controller comprises:

a signal processing part outputting the image driving signal in response to the first and second external image control signals; and a frequency selection part adapted to automatically select one of the first and second frequencies based on the first external image control signal, to control the signal processing part.

3. The control board of claim 2, wherein the timing controller comprises:

a first signal receiving part electrically connected to the first connector, to receive the first external image control signal; and a second signal receiving part electrically connected to the second connector, to selectively receive the second external image control signal.

4. The control board of claim 3, wherein the timing controller further comprises a signal counter electrically coupled to the first signal receiving part and the frequency selection part to receive a data enable signal of the first external image control signal from the first signal receiving part, the counter being operative to count the data enable signal and generate an internal frequency selection signal.

5. The control board of claim 2, further comprising a logic level shifting circuit electrically coupled to the second connector and to the frequency selection parts, the logic level shifting circuit being operative to output an external frequency selection signal controlling the frequency selection part to the frequency selection part.

6. The control board of claim 5, wherein the logic level shifting circuit is electrically coupled to a power input pin of the second connector.

7. The control board of claim 1, further comprising:

a first preset memory electrically coupled to the timing controller to provide to the timing controller preset data applicable for operation at the first frequency; and a second preset memory electrically coupled to the timing controller, to provide the timing controller preset data applicable for operation at the second frequency.

8. The control board of claim 7, wherein the timing controller transfers a signal via the first and second preset memories and an inter-integrated circuit ($I^2C$) bus.

9. The control board of claim 1, wherein the first frequency is about 120 Hz, and the second frequency is about 60 Hz.

10. The control board of claim 1, wherein the second external image control signal comprises odd-numbered line image data when the first external image control signal of the first frequency comprises even-numbered line image data, and the second external image control signal comprises the even-numbered line image data when the first external image control signal of the first frequency comprises odd-numbered line image data.

11. A display apparatus comprising a control board, a driving unit controlled by the control board, and a display panel driven by the driving unit to display an image, wherein the control board comprises:

a timing controller adapted to receive a first external image control signal having one of a first frequency and a second frequency and to selectively receive a second external image control signal having the first frequency when the first external image control signal has the first frequency, the timing controller being operative to select one of the first and second frequencies based on the first and second external image control signals and to output an image driving signal;

a first connector connecting the timing controller to the video system and transferring the first external image control signal to the timing controller; and a second connector connecting the timing controller to the video system and transferring the second external image control signal to the timing controller.

12. The display apparatus of claim 11, wherein the first frequency is about 120 Hz, and the second frequency is about 60 Hz.

13. The display apparatus of claim 11, further comprising a logic level shifting circuit electrically coupled to the second connector and to the frequency selection parts, the logic level shifting circuit being operative to output an external frequency selection signal controlling the frequency selection part to the frequency selection part.

14. The display apparatus of claim 11, further comprising:

a first preset memory electrically coupled to the timing controller to provide to the timing controller preset data applicable for operation at the first frequency; and a second preset memory electrically coupled to the timing controller, to provide the timing controller preset data applicable for operation at the second frequency.

15. The display apparatus of claim 11, wherein the second external image control signal comprises odd-numbered line image data when the first external image control signal of the first frequency comprises even-numbered line image data, and the second external image control signal comprises the even-numbered line image data when the first external image control signal of the first frequency comprises odd-numbered line image data.

* * * * *